US010851531B2

(12) United States Patent
Burkhardt et al.

(10) Patent No.: US 10,851,531 B2
(45) Date of Patent: Dec. 1, 2020

(54) DRAIN FITTING FOR A TOILET CISTERN

(71) Applicant: GROHEDAL Sanitaersysteme GmbH, Porta Westfalica (DE)

(72) Inventors: Juergen Burkhardt, Verl (DE); Christian Koch, Porta Westfalica (DE); Sven Woehler, Porta Westfalica (DE)

(73) Assignee: GROHEDAL Sanitaersysteme GmbH, Porta Westfalica (DE)

( * ) Notice: Subject to any disclaimer, the term of this patent is extended or adjusted under 35 U.S.C. 154(b) by 0 days.

(21) Appl. No.: 16/288,603

(22) Filed: Feb. 28, 2019

(65) Prior Publication Data

US 2019/0194922 A1 Jun. 27, 2019

Related U.S. Application Data

(63) Continuation of application No. PCT/EP2017/001024, filed on Aug. 29, 2017.

(30) Foreign Application Priority Data

Aug. 29, 2016 (DE) ..... 10 2016 010 335

(51) Int. Cl.

| | |
|---|---|
| ***E03D 5/02*** | (2006.01) |
| ***E03D 3/12*** | (2006.01) |
| ***E03D 1/30*** | (2006.01) |
| ***E03D 1/14*** | (2006.01) |

(52) U.S. Cl.

CPC ..... *E03D 5/024* (2013.01); *E03D 1/144* (2013.01); *E03D 1/302* (2013.01); *E03D 3/12* (2013.01)

(58) Field of Classification Search

CPC E03D 5/024; E03D 5/06; E03D 1/302; E03D 1/144; E03D 1/08; E03D 1/142; E03D 1/36; E03D 3/12

USPC ..... 4/407

See application file for complete search history.

(56) References Cited

U.S. PATENT DOCUMENTS

| | | | |
|---|---|---|---|
| 4,809,367 | A | 3/1989 | Scott |
| 2014/0026309 | A1 | 1/2014 | Le et al. |

FOREIGN PATENT DOCUMENTS

| | | | |
|---|---|---|---|
| EP | 1719846 | A2 | 11/2006 |
| ES | 1010179 | U | 12/1989 |
| WO | WO2006012650 | A1 | 2/2006 |

OTHER PUBLICATIONS

International Search Report dated Nov. 27, 2017 in corresponding application PCT/EP2017/001024.

*Primary Examiner* — Erin Deery

(74) *Attorney, Agent, or Firm* — Muncy, Geissler, Olds & Lowe, P.C.

(57) ABSTRACT

A drain fitting for a toilet cistern including a drain valve, which is constructed from a discharge nozzle mounted on the cistern and a lift-adjustable overflow tube, which closes a flow passage through the discharge nozzle in its closed position, and having a pneumatic actuator, with the aid of which, upon the application of pressure, the overflow tube is adjustable into its open position, in which a quantity of flush water is able to flow out of the discharge nozzle of the toilet cistern. An underpressure may be applied to the pneumatic actuator to lift-adjust the overflow tube into its open position. The drain fitting includes an, in particular water-conducting, underpressure unit, which is connected to the pneumatic actuator and generates an underpressure acting upon the pneumatic actuator upon activation by the user.

16 Claims, 6 Drawing Sheets

DRAIN FITTING FOR A TOILET CISTERN

This nonprovisional application is a continuation of International Application No. PCT/EP2017/001024, which was filed on Aug. 29, 2017, and which claims priority to German Patent Application No. 10 2016 010 335.3, which was filed in Germany on Aug. 29, 2016, and which are both herein incorporated by reference.

BACKGROUND OF THE INVENTION

Field of the Invention

The present invention relates to a drain fitting for a toilet cistern.

Description of the Background Art

In common practice, a toilet cistern has a fill valve connected to a water supply system as well as a drain valve. The toilet cistern may be filled with water up to a predefined fill level, for example via the float-controlled fill valve. The drain valve is usually constructed from a discharge nozzle mounted on the floor of the cistern and a lift-adjustable overflow tube. In its closed position, the overflow tube closes a through-flow through the discharge nozzle. When the user pressure-actuates a pushbutton, the overflow tube may be lift-adjusted into its open position, in which a quantity of flush water may flow out of the discharge nozzle of the toilet cistern. In a conventional toilet cistern, the pushbutton is operatively connected to the overflow tube via a mechanical linkage.

In contrast, a generic drain fitting is known from EP 1 719 846 A2, in which the pushbutton is not connected to the overflow tube via a mechanical linkage but instead via a pneumatic system. The pneumatic system includes a first bellows positioned at the pushbutton, which is connected via a pneumatic line to a second bellows positioned at the overflow tube. Upon pressure actuation of the pushbutton, the first bellows is compressed and thus generates an overpressure, which may be applied to the second bellows. The second bellows expands due to the application of overpressure, whereby the overflow tube is adjusted into its open position. The above pneumatic system takes up a great deal of installation space and also requires many components. The implementation of the pneumatic system is therefore associated with high costs and its assembly is also complex.

SUMMARY OF THE INVENTION

It is therefore an object of the present invention to provide a drain fitting for a toilet cistern, which requires less installation space compared to the prior art and may also be implemented with fewer components.

A bellows that lift-adjusts the overflow tube upon an application of overpressure, is dispensed within the pneumatic system. Instead, the pneumatic system according to an exemplary embodiment of the invention includes exactly one pneumatic actuator, to which an underpressure may be applied to lift-adjust the overflow tube. The drain fitting also includes an underpressure unit, which is fluidically connected to the pneumatic actuator. Upon an activation by the user, the underpressure unit generates an underpressure acting upon the pneumatic actuator to carry out a lift adjustment of the overflow tube.

The pneumatic system may be implemented as a bellows, a piston/cylinder unit or as a diaphragm lift system. The diaphragm lift system may have, for example, at least one working chamber to which an underpressure may be applied and which is delimited by a deformable diaphragm. The deformable diaphragm may be connected to the overflow tube. Upon the application of underpressure to the working chamber, the diaphragm may deform and lift-adjust the overflow tube accordingly. With regard to a particularly simple and functional design, the pneumatic actuator may be a bellows, which compresses in the manner of an accordion upon an application of underpressure and draws apart (i.e. expands) in the manner of an accordion upon the release of the underpressure.

The underpressure unit may be an electrically controllable vacuum pump or water-conducting underpressure unit, i.e. a vacuum nozzle or a water-jet vacuum pump. The vacuum nozzle/water-jet vacuum pump may be connected to the pneumatic actuator via an underpressure line. If water flows through the vacuum nozzle/water-jet vacuum pump, air is therefore extracted from the pneumatic actuator, i.e. an underpressure is generated in the pneumatic actuator.

The above water-conducting underpressure unit may have a choke with a flow cross-sectional constriction between its water inlet side and its water outlet side in the manner of a venturi tube. The underpressure line may preferably open into the flow channel of the underpressure unit at the choke.

An installation space-reduced and compact arrangement of the pneumatic system according to the invention is advantageous. Against this background, the pneumatic actuator (i.e., for example, the bellows) may be disposed, in particular in alignment, above the overflow tube in the drain fitting vertical direction. The pneumatic actuator may be preferably connected to the overflow tube via a rigid connecting element, which extends the overflow tube in the upward direction, for example coaxially. Alternatively and/or additionally, the underpressure unit may be disposed, in particular in alignment, above the pneumatic actuator, viewed in the drain fitting vertical direction, whereby a particularly installation space-reduced design of the pneumatic system is achieved.

The water-conducting underpressure unit may be connected on its water inlet side to a control line, which is connectable to the water supply system. The control line may preferably branch off from supply line leading to a fill valve of the toilet cistern. In this case, the line pressure, which is present in any case, is used for generating underpressure in the underpressure unit without additional external energy being necessary (for example, the pressure actuation by the user or electrical energy). The water-conducting underpressure unit may open directly into the interior of the toilet cistern on its water outlet side.

The above design variant is advantageous, in particular in the case of a toilet repair measure, in which the water supply line to the toilet cistern is cut off at a corner valve for preparation purposes. In this case, the water supply to the toilet cistern and to the underpressure unit is interrupted. In a conventional toilet cistern, in which the pushbutton is connected to the drain valve via a mechanical linkage, the installer must empty the toilet cistern before beginning repairs to prevent water from flowing out of the toilet cistern upon an unintentional actuation of the pushbutton.

According to the invention, such a precautionary emptying of the toilet cistern may be eliminated for the following reason: Namely, no water may be conducted through the control line due to the corner valve cutoff, so that the underpressure unit is not able to generate any underpressure. The drain valve thus remains reliably closed even upon an unintentional actuation of the pushbutton.

As mentioned above, the underpressure unit may be activated by the user. In the case of a water-conducting underpressure unit, a control valve actuatable by the user may be disposed for this purpose in the control line leading to the underpressure unit, i.e. upstream from the water-conducting underpressure unit. The water volume flow conducted through the underpressure unit, which, in turn, correlates with the underpressure generated in the underpressure unit, may be set by a user actuation of the control valve. For example, the control valve may be a time-controlled actuating valve, for example a so-called self-closing valve.

The control valve may include a lift-adjustable control piston in a valve housing. The control piston may be adjusted with the aid of at least one user-operable pushbutton. In its non-actuated position, the control piston is spring-pretensioned into a closed position, in which a control piston valve head is in sealing contact with housing-fixed valve seat, and a flow path through the control valve is thereby closed. Upon a pressure actuation of the pushbutton over a pushbutton travel distance, the control piston is adjusted into its open position against the spring pretensioning force. In the control piston open position, the flow path through the control valve is released, whereby water flows through the water-conducting underpressure unit. Upon a pressure release of the pushbutton, on the other hand, the control piston is reset to its closed position under the effect of the spring pretensioning force over a resetting travel distance.

The length of the above pushbutton travel distance of the pushbutton correlates with a reset time interval, within which the control piston is reset to its closed position after a pushbutton release. Within the reset time interval, the water volume flow passes through the water-conducting underpressure unit, and an underpressure is generated, which acts upon the pneumatic actuator. This means that the length of the pushbutton travel distance has a direct influence on the quantity of flush water flowing out of the toilet cistern. To set a maximum possible pushbutton travel distance of the pushbutton, and thus to set an outflowable quantity of flush water, a travel setting element may be assigned to the user-operable pushbutton, which sets the maximum pushbutton travel distance of the pushbutton and thus also the reset time interval.

In one technical design, the drain fitting may include a first pushbutton, upon whose actuation a large quantity of flush water flows out of the toilet cistern, and a second pushbutton, upon whose actuation a small quantity of flush water flows out of the toilet cistern. The user may thus define the quantity of flush water, depending on the actuation of the first or second pushbutton.

The two pushbuttons may be connected to the control piston in a force-transmitting manner, in particular, for example with a cross member connected therebetween, in such a way that upon pressure actuation of the first pushbutton, the second pushbutton remains in its idle position. The pushbutton travel distance covered by one of the pushbuttons is thus identical to the piston travel distance covered by the control piston. A travel setting element is preferably assigned to each of the two pushbuttons, with the aid of which the maximum possible pushbutton travel distances of the first and second pushbuttons may be set independently of each other. Different quantities of flush water may be variably set by a control valve of this type.

The advantageous embodiments and/or refinements of the present invention explained above and/or illustrated in the subclaims may be used individually or in any combination with each other except in cases where unmistakable dependencies or incompatible alternatives exist.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
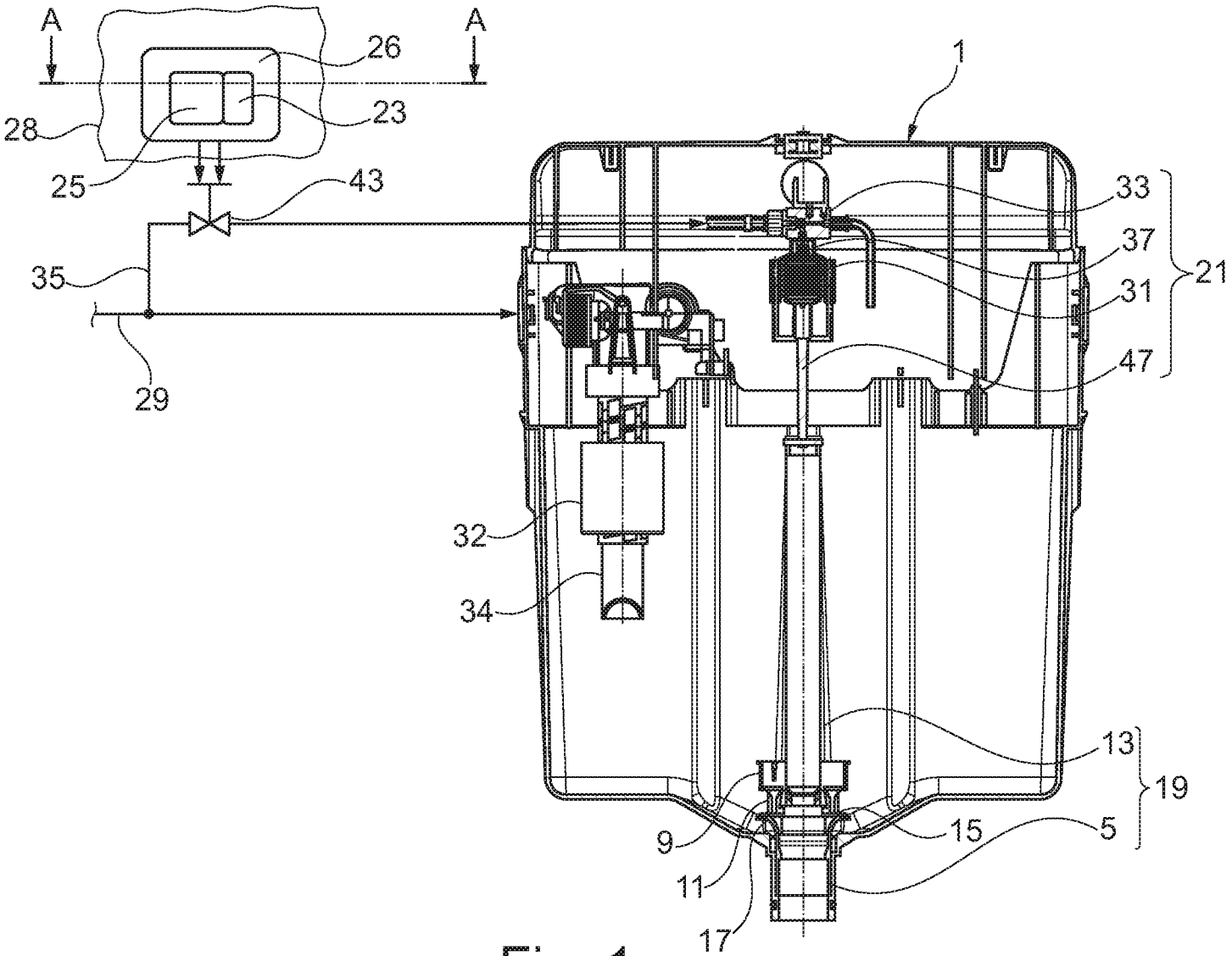
FIG. 1 shows a roughly schematic partial sectional view of a toilet cistern, including a fill valve and a drain valve.
Figure 6:
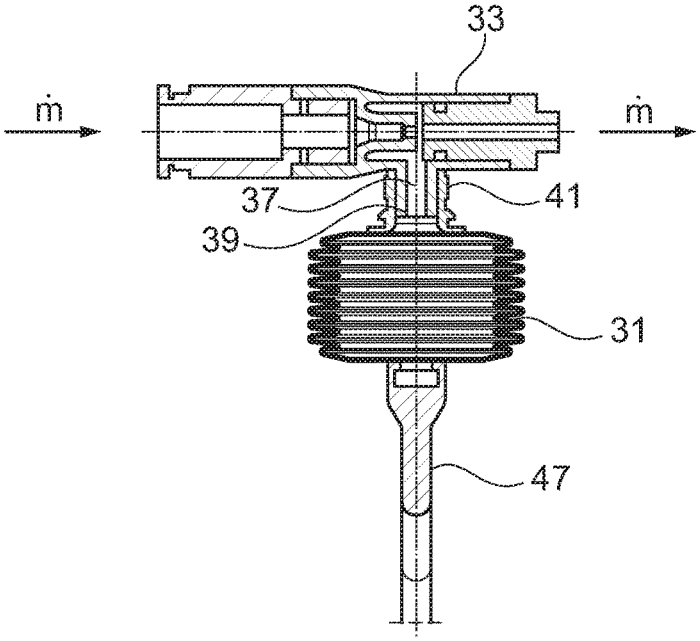
FIGS. 6 and 7 each show views illustrating the pneumatic system upon an application of underpressure by the bellows.
Figure 7:
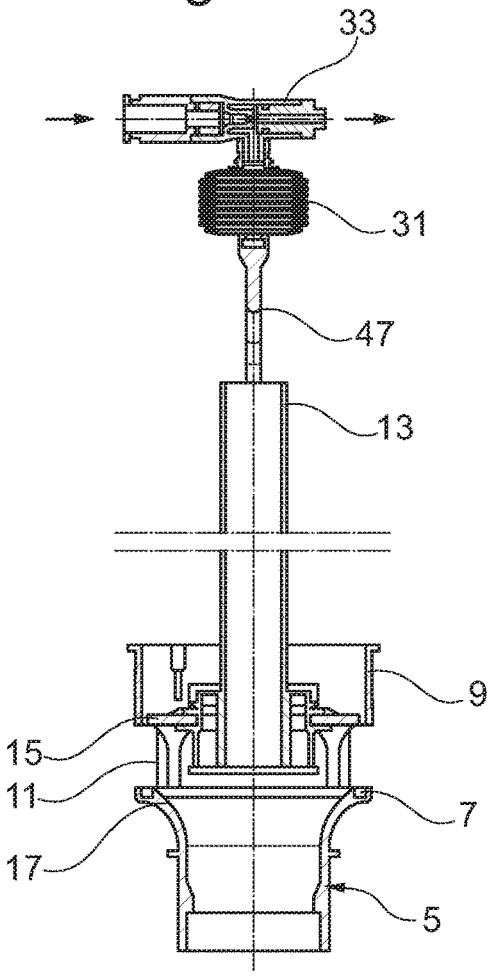

A drain fitting, including an associated pneumatic system 21, installed in a toilet cistern 1 is illustrated in FIG. 1. The drain fitting includes a discharge nozzle 5 on cistern floor 3, which is in flow connection with a toilet bowl. Discharge nozzle 5 rests by a radially widened, circumferential annular shoulder 7 on the opening edge area of a floor-side outlet opening of cistern floor 3. Annular shoulder 7 of discharge nozzle 5 is extended upwardly with a housing wall 9 formed thereon, in which through-flow openings 11 are formed, which are evenly distributed in the circumferential direction. A lift-adjustable overflow tube 13, which rests fluid-tight on a valve seat 17 formed on annular shoulder 7 by its radially outer valve head 15, is disposed radially inside housing wall 9 and coaxially thereto. Together with discharge nozzle 5, overflow tube 13 forms a drain valve 19, which is actuatable via pneumatic system 21 by pushbuttons 23, 25, which are surrounded by a decor plate 26 in FIG. 1 and are installed in a building wall 28. Upon a pressure actuation of pushbuttons 23, 25, overflow tube 13 is lift-adjusted from a closed position illustrated in FIG. 1 into an open position (FIGS. 6 and 7) with the aid of pneumatic system 21.

A fill valve 27 is also installed in toilet cistern 1, with the aid of which toilet cistern 1 is filled with water up to a predefined fill level. Fill valve 27 is connected on the inlet side to a supply line 29 leading to the water supply system. In addition, fill valve 27 is controlled with the aid of a float 32, which is disposed adjustable in height on an inlet tube 34.

Figure 2:
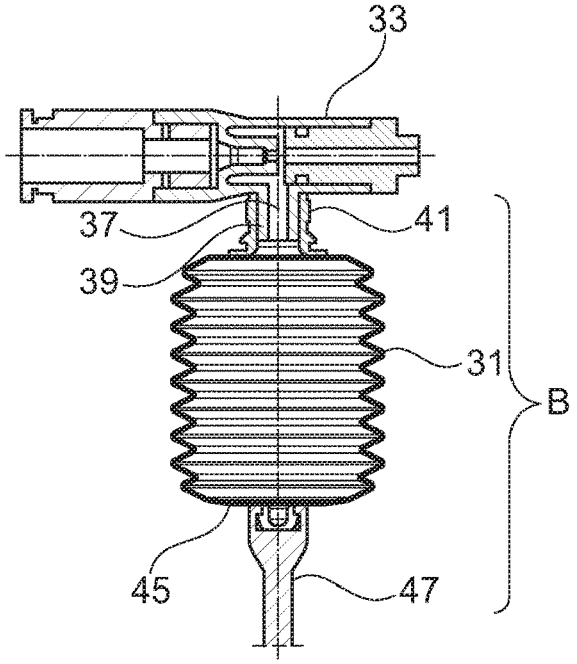
FIG. 2 shows a detailed view of a structural unit made up of a vacuum nozzle and a bellows.

As is further apparent from FIG. 1 or 2, pneumatic system 21 includes a bellows as pneumatic actuator 31 and a vacuum nozzle 33 as the underpressure unit. Vacuum nozzle 33 is designed in the manner of a venturi tube and is connected to a control line 35 on the inlet side, which branches off supply line 29. A control valve 43 is disposed in control line, 35, via which user-operable pushbutton 23, 25 may be actuated. Upon an actuation of the pushbutton, a water flow path from the supply system to vacuum nozzle 33 is opened in control valve 43, through which a water volume flow $\dot{m}$ (FIG. 3 or 6) passes. An underpressure, which causes bellows 31 to compress, is generated in this manner in underpressure line 37.

Vacuum nozzle 33 opens into the interior of toilet cistern 1 on the outlet side. Between its water inlet and outlet sides, vacuum nozzle 33 has a choke with a flow cross-sectional constriction, at which an underpressure line 37 opens into the nozzle channel of vacuum nozzle 33. Vacuum nozzle 33 and bellows 31 are connected directly to each other, forming a structural unit B (FIG. 2). For this purpose, vacuum nozzle 33 in FIG. 2 includes a connecting piece 39, through which underpressure line 37 passes. A pipe socket 41 of bellows 31 is pushed onto connecting piece 39 of vacuum nozzle 33 and possibly fixed thereon with the aid of a bracket. Bellows 31 in FIG. 2 is coupled by its bellows base 45 facing away from pipe socket 41 to a connecting rod 47, which, in turn, is fastened to the upper end of overflow tube 13.

Figure 3:
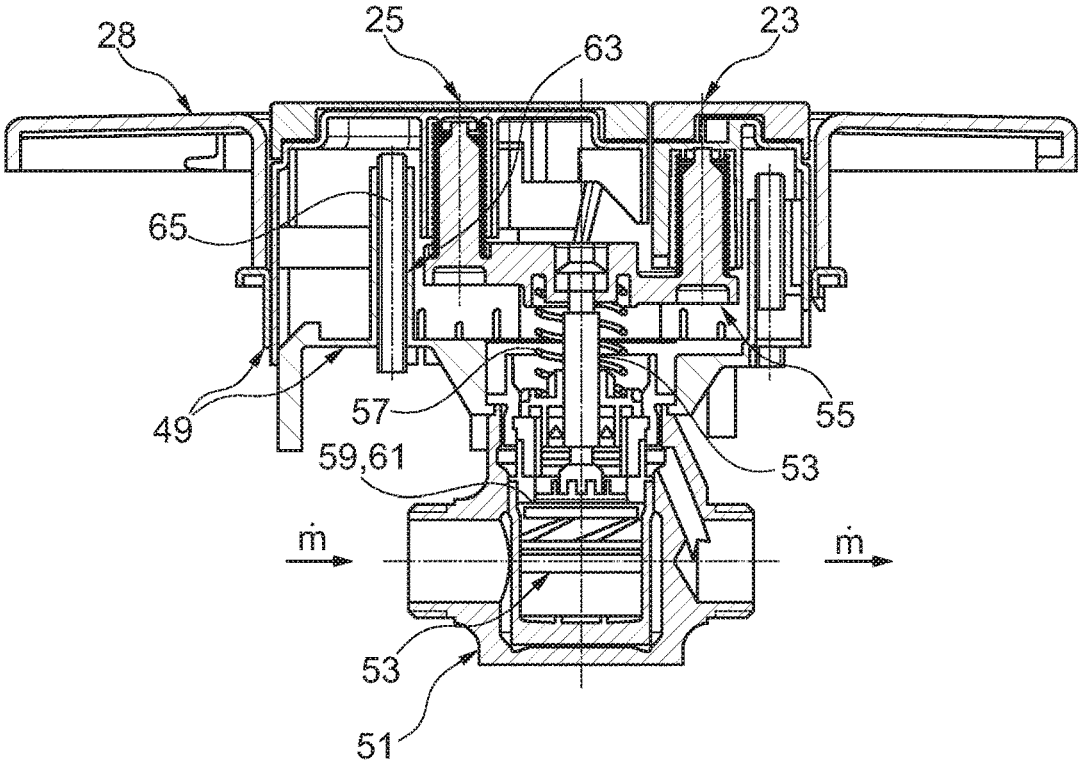
FIG. 3 shows a sectional representation along sectional plane A-A from FIG. 1.

Control valve 43 illustrated in FIG. 3 also forms a structural unit with a pushbutton housing 49, in which the two pushbuttons 23, 25 are disposed. In FIG. 3, control valve 43 includes a lift-adjustable control piston (53) in a valve housing 51. Control piston 53 is connected in a force-transmitting manner to the two pushbuttons 23, 25, a cross member 55 being connected therebetween. In the non-use position illustrated in FIG. 3, control piston 53 is spring-pretensioned into a closed position with the aid of a spiral spring 57. In the closed position illustrated in FIG. 3, valve head 59 of control piston 53 is in sealing contact with a housing-fixed valve seat 61, whereby the flow path through control valve 43 is closed.

Figure 4:
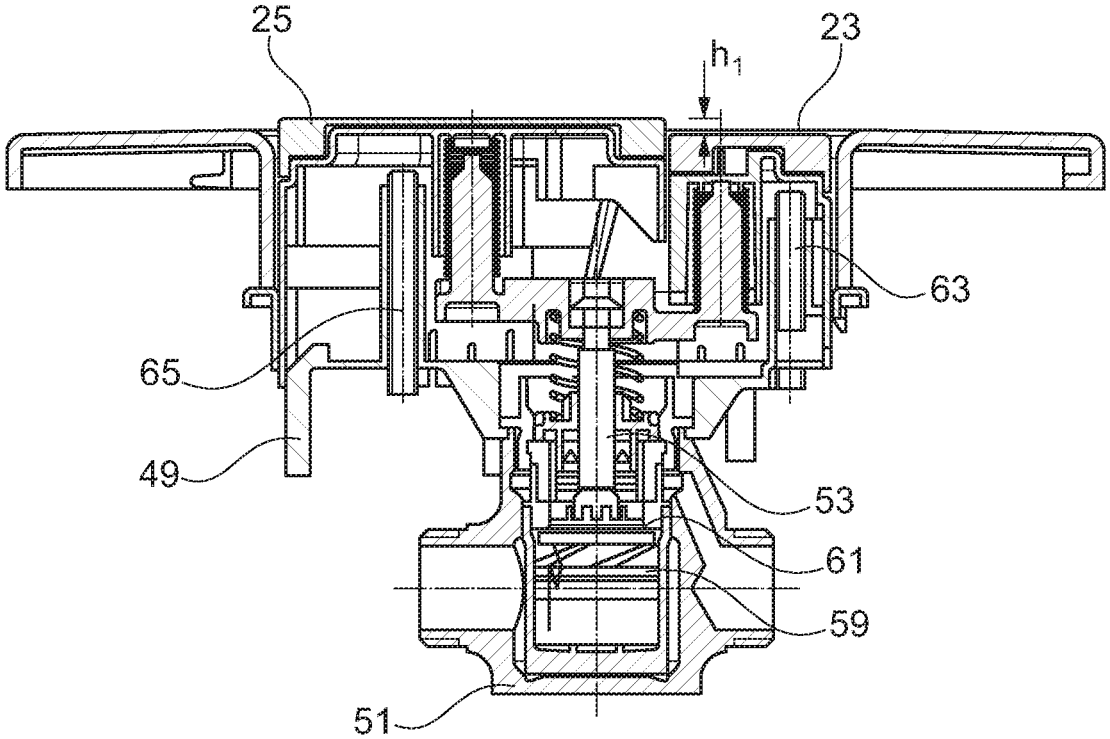
FIGS. 4 and 5 each show views according to FIG. 3 with an actuated first pushbutton and an actuated second pushbutton.
Figure 5:
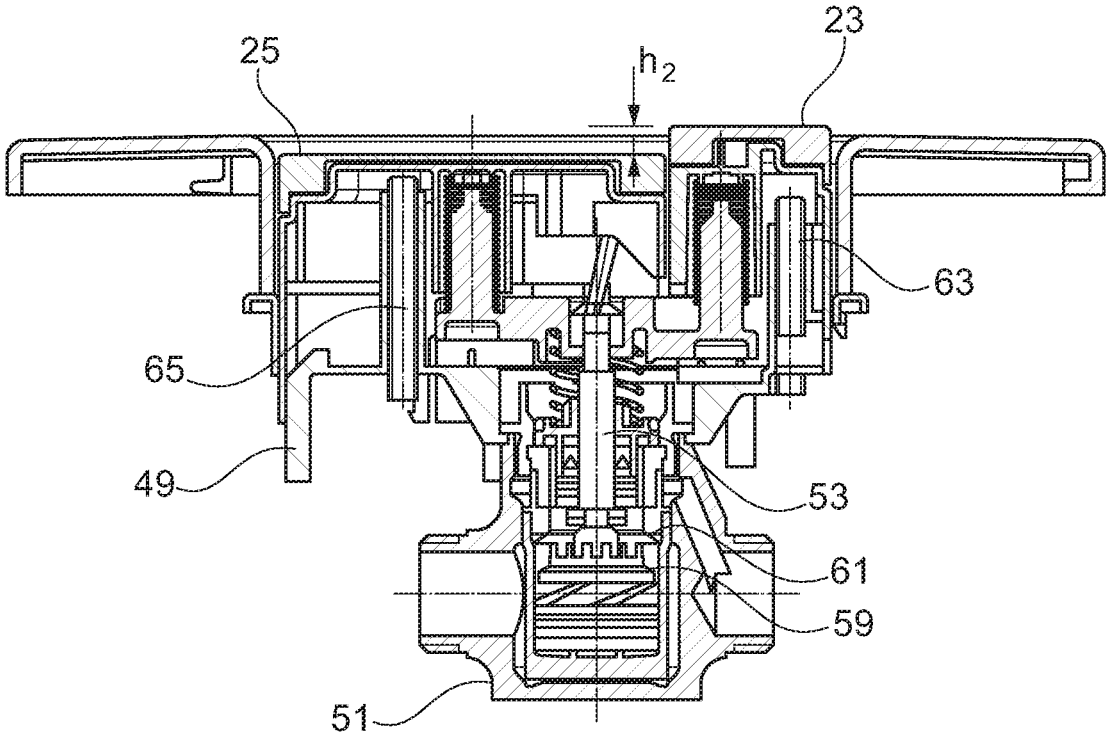

First and second pushbuttons 23, 25 are adjustable into an open position over maximum possible pushbutton travel distances $h_1$, $h_2$ against the spring pretensioning force generated by spiral spring 57 (FIG. 4 or 5). In the open position, the flow path through control valve 43 is released. Upon a pressure release of pushbutton 23, 25 pressed in each case, pushbutton 23, 25 is reset into its closed position under the effect of the spring pretensioning force of spiral spring 57.

To set aforementioned pushbutton travel distances $h_1$, $h_2$, control valve 43 includes two travel setting elements 63, 65, which are disposed in box frame 49, adjustable in a lift direction. Each of travel setting elements 63, 65 is assigned to one of pushbuttons 23, 25. A maximum possible pushbutton travel distance $h_1$, $h_2$ of pushbutton 23, 25 may be set with the aid of travel setting elements 63, 65. Travel setting elements 63, 65 act as depth stops, which limit the travel distance of particular pushbutton 23, 25.

If a pushbutton release takes place after the pushbutton actuation, control piston 53 automatically returns to its closed position under the effect of the spring force, within a reset time interval. Within the reset time interval, the flow path through control valve 43 remains open, so that a water volume flow $\dot{m}$ continues to be conducted through vacuum nozzle 33, thereby generating an underpressure. The length of the reset time interval correlates with a pushbutton travel distance. This means that the resetting of pushbutton 23, 25 takes longer in the case of a long pushbutton travel distance than in the case of a shorter pushbutton travel distance. Accordingly, a greater quantity of flush water may flow out of toilet cistern 1 in the case of a long pushbutton travel distance than in the case of a shorter pushbutton travel distance.

A separate quantity of flush water flowing out of toilet cistern 1 may thus be assigned to each of pushbuttons 23, 25, due to separate settings of travel setting elements 63, 65. For example, a small quantity of flush water may flow out of toilet cistern 1 upon the actuation of first pushbutton 23. In contrast, a larger quantity of flush water may flow out of toilet cistern 1 upon the actuation of second pushbutton 25.

With respect to a compact, installation space-saving design of pneumatic system 21, according to the figures, bellows 31 is positioned in alignment above overflow tube 13 in the drain fitting vertical direction. In addition, vacuum nozzle 33 is positioned in approximate alignment above bellows 31.

Figure 8:
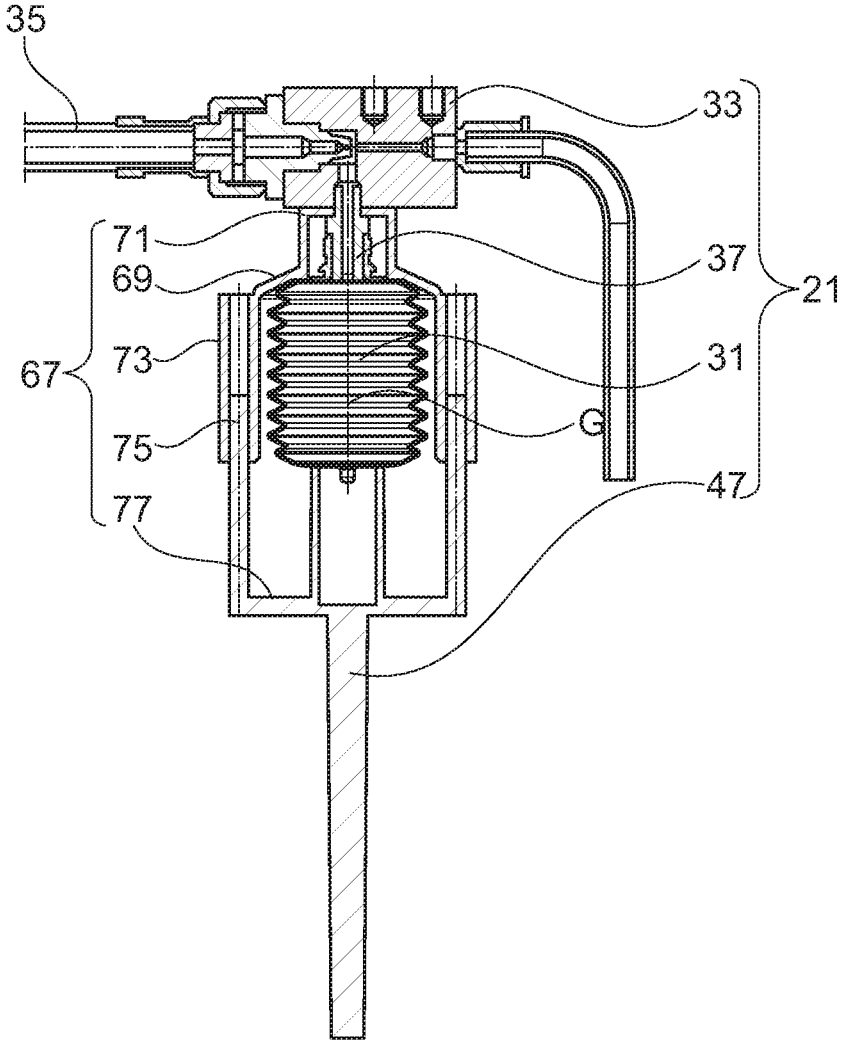
FIG. 8 shows a pneumatic system of the toilet cistern according to another exemplary embodiment.

FIG. 8 shows a refinement of pneumatic system 21 illustrated in the preceding figures. In contrast to the preceding figures, a bellows guide 67 is also provided in FIG. 8 to ensure a flawless compression and expansion of bellows 31. Bellows guide 67 includes a hollow cylindrical, cup-like bellows housing 69, which is rotationally symmetrically designed with respect to a housing axis G and is fastened to vacuum nozzle 33 by its cup base 71. Guide channels 73, in which guide pins 75 are guided axially parallel to housing axis G, are formed on the outer circumference of bellows housing 69. Guide pins 75 are fastened to connecting rod 47 via transverse webs 77.

Figure 9:
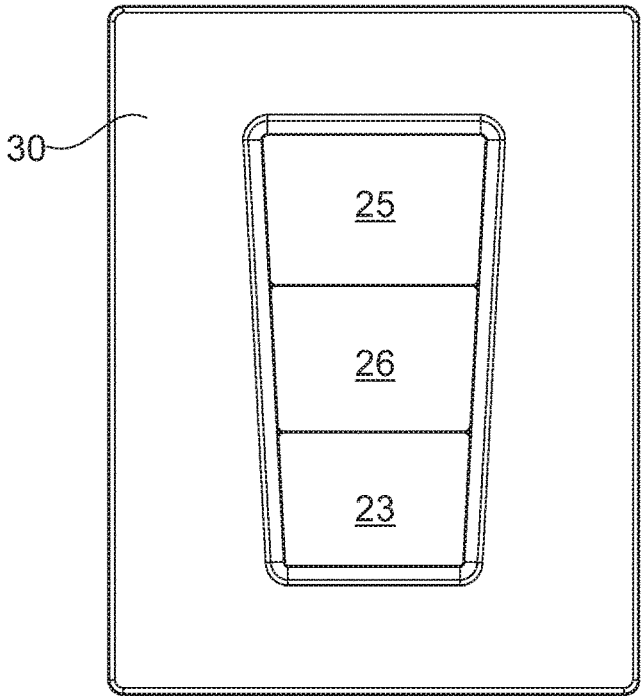
FIGS. 9 and 10 show another exemplary embodiment of a drain fitting.
Figure 10:
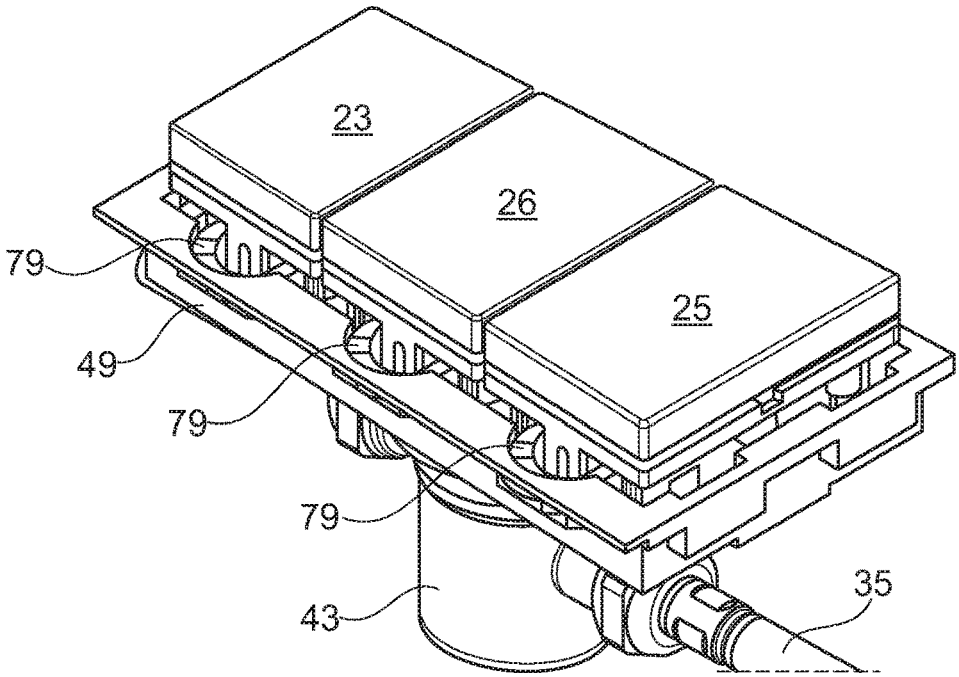

In contrast to the preceding specific embodiments, an additional, third pushbutton 26 is provided in FIGS. 9 and 10, which is surrounded by decor plate 30 together with the two other pushbuttons 23, 25. Upon pressing third pushbutton 26, a medium quantity of flush water may flow out of toilet cistern 1. Like the two other pushbuttons 23, 25, third pushbutton 26 is connected to control piston 53 in a force-transmitting manner, cross member 55 being connected therebetween. Moreover, a travel setting element is also assigned to third pushbutton 26, with the aid of which the maximum possible pushbutton travel of third pushbutton 26 may be set.

As is apparent from FIG. 10, an adjusting wheel 79 is assigned to each of the travel setting elements, which may be rotated by the used. The travel setting element assigned in each case may be adjusted with the aid of a rotation actuation.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A toilet cistern having a drain fitting, comprising:

a drain valve that is formed from a discharge nozzle mounted on the cistern and a liftable overflow tube, wherein in a closed position of the overflow tube, a through-flow through the discharge nozzle is closed;

a pneumatic actuator, wherein when an underpressure acts upon the pneumatic actuator, the pneumatic actuator lifts the overflow tube into an open position, in which a quantity of flush water is able to flow out of the discharge nozzle of the toilet cistern; and a water-conducting underpressure unit which is connected to the pneumatic actuator and generates the underpressure that acts upon the pneumatic actuator when the underpressure unit is activated by a user.

2. The toilet cistern having the drain fitting according to claim 1, wherein the pneumatic actuator is a bellows or a piston/cylinder unit.

3. The toilet cistern having the drain fitting according to claim 1, wherein the underpressure unit is a vacuum nozzle through which water flows, the vacuum nozzle being connected to the pneumatic actuator by an underpressure line, and when water flows through the vacuum nozzle, air may be is extracted from the pneumatic actuator.

4. The toilet cistern having the drain fitting according to claim 3, wherein a water inlet side of the underpressure unit is connected to a control line, wherein the control line is connectable to a water supply system.

5. The toilet cistern having the drain fitting according to claim 4, wherein a user-actuatable control valve is disposed in the control line, and a water volume flow conducted through the underpressure unit, which correlates with the underpressure generated in the underpressure unit, is settable upon an actuation of the control valve by the user.

6. The toilet cistern having the drain fitting according to claim 5, wherein the control valve includes a liftable control piston in a valve housing which is adjustable with the aid of at least one user-operable pushbutton and is spring-pretensioned into a closed position in which a control piston valve head is in sealing contact with a housing-fixed valve seat and closes a flow path through the control valve, wherein the control piston is adjusted into the open position in which the flow path through the control valve is released against a spring pretensioning force over a pushbutton travel distance upon a pressure actuation of the at least one user-operable pushbutton, and wherein the control piston is reset to the closed position under the effect of the spring pretensioning force upon a pressure release of the at least one user-operable pushbutton.

7. The toilet cistern having the drain fitting according to claim 6, wherein a length of the pushbutton travel distance correlates with a length of a reset time interval, within which the control piston is reset to the closed position after a release of the at least one user-operable pushbutton, wherein the water volume flow passes through the underpressure unit within the reset time interval and the underpressure is generated.

8. The toilet cistern having the drain fitting according to claim 7, wherein a travel setting element is assigned to the at least one user-operable pushbutton of the control valve, the travel setting element setting a maximum possible pushbutton travel distance of the at least one user-operable pushbutton and thus setting the reset time interval.

9. The toilet cistern having the drain fitting according to claim 6, wherein the at least one user-operable pushbutton includes a first pushbutton, a second pushbutton and a third pushbutton, wherein upon actuation of the first pushbutton a small quantity of flush water flows out of the toilet cistern, upon actuation of the second pushbutton a large quantity of flush water flows out of the toilet cistern and upon actuation of the third pushbutton a medium quantity of flush water flows out of the toilet cistern.

10. The toilet cistern having the drain fitting according to claim 9, wherein the first, second and third pushbuttons are connected to the control piston in a force-transmitting manner with one cross member being connected between each of the first, second and third pushbuttons, such that, upon the pressure actuation of one of the first, second or third pushbuttons, the other two of the first, second or third pushbuttons remain in an idle position.

11. The toilet cistern having the drain fitting according to claim 9, wherein a travel setting element is assigned to each of the first, second and third pushbuttons, wherein the travel setting element sets a maximum possible pushbutton travel distance of each of the first, second and third pushbuttons independently of each other.

12. The toilet cistern having the drain fitting according to claim 3, wherein the underpressure unit has a choke with a flow cross-sectional constriction between a water inlet side and a water outlet side, and the underpressure line opens into a flow channel of the underpressure unit at the choke.

13. The toilet cistern having the drain fitting according to claim 1, wherein the pneumatic actuator compresses upon an application of the underpressure to lift the overflow tube into the open position, and the pneumatic actuator expands upon a release of the underpressure, so that the overflow tube moves into the closed position under the effect of gravity.

14. The toilet cistern having the drain fitting according to claim 1, wherein the pneumatic actuator is disposed, in alignment, above the overflow tube in a drain fitting vertical direction and, wherein the pneumatic actuator is rigidly connected to the overflow tube with a connecting element.

15. The toilet cistern having the drain fitting according to claim 14, wherein the underpressure unit is disposed, in alignment, above the pneumatic actuator in the drain fitting vertical direction.

16. The toilet cistern having the drain fitting according to claim 1, wherein the toilet cistern includes a fill valve, an inlet side of the fill valve being connectable to a water supply system via which the toilet cistern is filled with water.

* * * * *